United States Patent [19]

Kawahara et al.

[11] Patent Number: 4,509,404

[45] Date of Patent: Apr. 9, 1985

[54] MASTER/SLAVE FLUID PRESSURE APPARATUS

[75] Inventors: Masakatsu Kawahara, Amagasaki; Masaru Takeda, Kobe, both of Japan

[73] Assignee: Kobe Steel, Limited, Kobe, Japan

[21] Appl. No.: 525,427

[22] Filed: Aug. 22, 1983

Related U.S. Application Data

[63] Continuation of Ser. No. 214,679, Dec. 9, 1980, abandoned.

[30] Foreign Application Priority Data

Dec. 14, 1979 [JP] Japan ..... 54-162985

[51] Int. Cl.[3] ..... F15B 13/16

[52] U.S. Cl. ..... 91/388; 91/461

[58] Field of Search ..... 91/388, 461

[56] References Cited

U.S. PATENT DOCUMENTS

| | | | |
|---|---|---|---|
| 2,974,639 | 3/1961 | Connor | 91/388 |
| 3,626,809 | 12/1971 | Pieper | 91/434 |
| 3,872,773 | 3/1925 | Denker | 91/388 |
| 4,133,250 | 1/1979 | Heintz | 91/364 |
| 4,163,413 | 8/1979 | Kennicutt | 91/521 |

FOREIGN PATENT DOCUMENTS

| | | | |
|---|---|---|---|
| 2302446 | 1/1973 | Fed. Rep. of Germany | 91/388 |
| 2811585 | 9/1979 | Fed. Rep. of Germany | 91/388 |
| 835814 | 5/1960 | United Kingdom . | |
| 1009650 | 11/1965 | United Kingdom . | |
| 1019178 | 2/1966 | United Kingdom . | |
| 1099281 | 1/1968 | United Kingdom . | |
| 1174244 | 12/1969 | United Kingdom . | |

*Primary Examiner*—Paul E. Maslousky

*Attorney, Agent, or Firm*—Oblon, Fisher, Spivak, McClelland & Maier

[57] ABSTRACT

A master/slave fluid-pressure apparatus having a first valve respective to angular movement of a master arm for producing fluid pressure which is applied as a pilot pressure to shift a closed-center three-position directional valve in one direction, which then allows a fluid-pressure actuator to be operated to cause a slave arm to follow the master arm in angular motion. The angular movement of the slave arm actuates a second valve coacting therewith to develop a fluid pressure which is applied as another pilot pressure to the directional valve. When the fluid pressure from the second valve reaches a predetermined point, the directional valve is shifted in the opposite direction to stop operation of the fluid-pressure actuator. The first and second valves may either be pressure reducing valves or relief valves.

1 Claim, 5 Drawing Figures

MASTER/SLAVE FLUID PRESSURE APPARATUS

This application is a continuation of application Ser. No. 214,679, filed Dec. 9, 1980, now abandoned.

BACKGROUND OF THE INVENTION

1. Field of the Invention

The present invention relates to a fluid-pressure apparatus for controlling a slave member to follow a master member in motion.

2. Description of the Prior Art

Conventional master/slave actuator apparatuses include an electro-hydraulic servo valve which are supplied with an electrical signal responsive to angular displacement of a master arm and another electrical signal responsive to angular displacement of a slave arm for controlling a hydraulic actuator which drives the slave arm so as to follow the master arm in angular motion.

As is well known, the electro-hydraulic servo valve is of poor reliability and tends to malfunction when used in adverse environments. More specifically, dirt in hydraulic operating fluid is likely to get jammed in the orifice of a nozzle-flapper or the small clearance around a spool. The magnetic characteristics of a solenoid coil may be changed due to drastic changes in ambient temperature, resulting in malfunctioning of the value. The valve is liable to operate improperly when the hydraulic operating oil is heated with resulting changes in viscosity and expansion of a spool. The electro-hydraulic servo valve is also disadvantageous in that its manufacture requires high precision and hence is expensive to manufacture. The master/slave actuator apparatuses which rely on such an electro-hydraulic servo valve are accordingly not reliable in operation in harmful applications and are costly to construct. Such apparatuses have found little use in rugged applications such as for example manipulators in foundries and smith shops, tunnel boring machines, construction machines, loading and unloading machines, or machines for use in ocean development.

SUMMARY OF THE INVENTION

It is an object of the present invention to provide a master/slave fluid-pressure apparatus which is reliable in operation in harmful applications.

Another object of the present invention is to provide a master/slave fluid-pressure apparatus which is inexpensive to construct.

According to the present invention, a hydraulic actuator for actuating a slave arm is connected to a source of fluid pressure via a three-position directional valve having a pilot chamber to which is applied a pressure signal from a first mechanism for converting a displacement of a master arm into a fluid pressure, and another pilot chamber to which is applied a pressure signal from a second mechanism for converting displacement of the slave arm into a fluid pressure to thereby control the directional valve so as to enable the slave arm to follow the master arm in motion. The first and second mechanism may includes either pressure reducing valves or relief valves.

BRIEF DESCRIPTION OF THE DRAWINGS

Various other objects, features and attendant advantages of the present invention will be more fully appreciated as the same becomes better understood from the following detailed descripton when considered in connection with the accompanying drawings in which like reference characters designate like or corresponding parts through the several views and wherein.

DETAILED DESCRIPTION OF THE PREFERRED EMBODIMENTS

Figure 1:
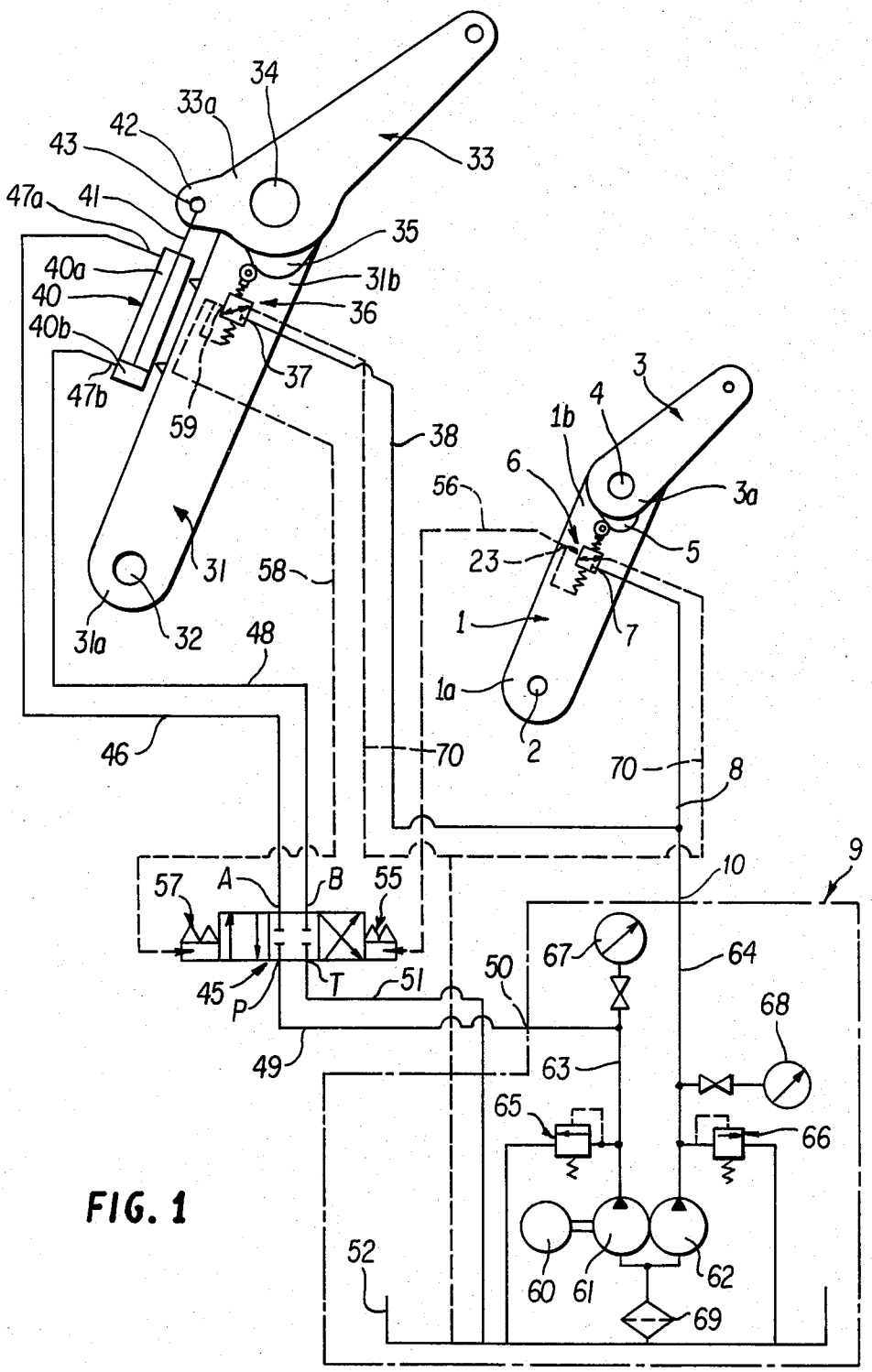
FIG. 1 is a circuit diagram of a fluid-pressure apparatus according to a first embodiment of the present invention.

As shown in FIG. 1, the master/slave fluid-pressure apparatus of the present invention includes a master boom 1 which has one end 1*a* pivotally connected to a shaft 2 and is connected at the other end 1*b* by a shaft 4 to a master arm 3 at an end 3*a* thereof, the master arm 3 being angularly movable about the shaft 4 with respect to the master boom 1. Master arm 3 has a cam 5 mounted on the end 3*a* thereof. Master boom 1 supports on its end 1*b* a first remote control valve 6 which coact with the cam 5 to convert positional changes of the master arm 3 into pressure changes as described herein. Valve 6 has an inlet port 7 connected via a fluid line 8 to a port 10 of a source of hydraulic pressure 9.

Figure 2:
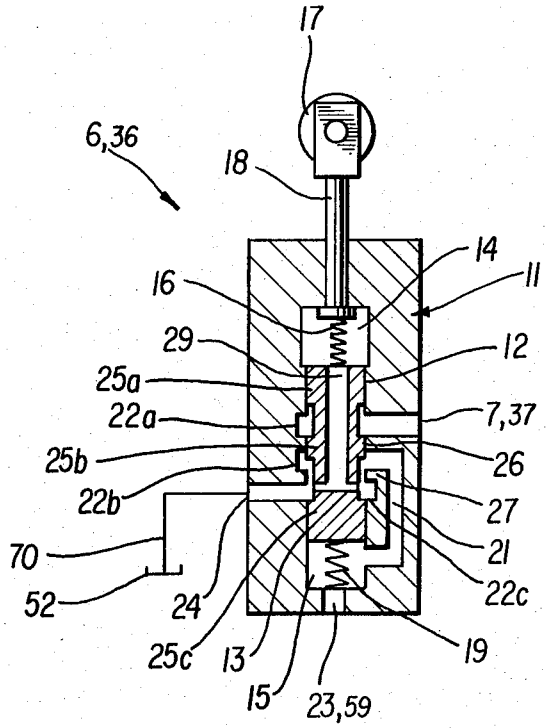
FIG. 2 is an enlarged cross-sectional view of a pressure control valve in the apparatus shown in FIG. 1.

As shown in FIG. 2, the valve 6 is in the form of a pressure reducing valve including a valve body 11 having a spool chamber 12 in which a spool 13 is slidably fitted. Valve body 11 also includes a pair of chambers 14, 15 spaced axially from each other and located one on each side of the spool chamber 12 in communication therewith. A compression coil spring 16 is disposed in the chamber 14 and has one end held against an end of the spool 13. The other end of the spring 16 is held against an end of a roller lever 18 which is axially slidable in the valve body 11 and supports on the other end thereof a roller 17 serving as a cam follower rollingly engaging the cam 5 of the master arm 3. The chamber 15 contains therein a compression coil spring 19 having one end held against the other end of the spool 13, the spring 19 being weaker in strength than the spring 16 for positioning the spool 13.

Spool chamber 12 has axially spaced, annular grooves 22*a*, 22*b*, 22*c*. The annular groove 22*a* is held in fluid communication with the intake port 7, the annular groove 22*b* with the chamber 15 through a passage 21, and the annular groove 22*c* with a tank port 24. Valve body 11 has an outlet port 23 communicating with the chamber 15.

Spool 13 has axially spaced, annular lands 25*a*, 25*b*, 25*c*. Spool 13 is determined as to its axial position in the spool chamber 12 by the resilient force from the spring 16 and the fluid pressure in the chamber 15, such that the land 25*b* is axially positionable between an inner annular surface 26 defined between the annular grooves 22*a*, 22*b* and an inner annular surface 27 defined between the annular grooves 22*b*, 22*c* to allow fluid to flow from the inlet port 7 through the passage 21, the chamber 15 to the outlet port 23. When the outlet port 23 is pressurized up to a predetermined point, excess fluid from the inlet port 7 is discharged through the port 24. Accordingly, the fluid pressure in the outlet port 23 is responsive to the force of the spring 16 as varied by axial movement of the roller lever 18. Spool 13 has an axial passage 29 which provides fluid communication between the chamber 14 and the port 24.

In FIG. 1, a slave boom 31 is pivotally mounted at an end 31*a* on a shaft 32. To the other end 31*b* of the slave boom 31, there is connected by a shaft 34 an end 33*a* of an angularly movable slave arm 33 having a cam 35 with which coacts a second remote control valve 36 fixedly mounted on the end 31*b* of the slave boom 31. The second valve 36 is of the same construction as that of the first valve 6, and has an inlet port 37 connected via a fluid line 38 to the port 10 of the fluid pressure supply 9.

A hydraulic actuator or cylinder 40 is secured to the end 31*b* of the slave boom 31, the cylinder 40 including a piston rod 41 having a distal end pivotally coupled by a pin 43 to a lobe 42 on the end 33*a* of the slave arm 33. Thus, the slave arm 33 is angularly movable by the hydraulic cylinder 40 relatively to the slave boom 31.

A closed-center, three-position directional valve 45 has a port A side connected via a fluid line 46, a port 47*a* to a rod-side chamber 40*a* of the cylinder 40, and a port B connected via a fluid line 48, a port 47*b* to a blind-side chamber 40*b* of the cylinder 40. The directional valve 45 also has a pressure port P connected via a fluid line 49 to a port 50 of the fluid-pressure source 9, and a tank port T connected via a fluid line 51 to a tank 52 in the supply 9. Directional valve 45 has at one end thereof a pilot chamber 55 coupled via a pilot line 56 to the outlet port 23 of the first remote control valve 6, and at the other end a pilot chamber 57 coupled via a pilot line 58 to an outlet port 59 of the second remote control valve 36.

Fluid-pressure supply 9 includes a high-pressure pump 61 and a low-pressure pump 62, both of which are coupled to a motor 60 for being driven thereby. The pump 61 is connected via a fluid line 63 to the port 50, and the pump 62 is connected via a fluid line 64 to the port 10. Fluid lines 63, 64 are connected respectively to relief valves 65, 66 for protection against an excessive pressure build-up. A pair of pressure gauges 67, 68 are connected to the fluid lines 63, 64, respectively. Pump 61, 62 are connected to the tank 52 via a filter for being supplied with oil.

The tank port 24 of each remote control valve 6, 36 is connected via a fluid line 70 to the tank 52 as shown in FIG. 2.

The master/slave fluid-pressure apparatus thus constructed will operate as follows:

When the master arm 3 is angularly moved by a suitable means (not shown) with respect to the master boom 1 in a clockwise direction as shown in FIG. 1, the cam 5 depresses the roller of the valve 6 to compress the spring 16 so that the fluid pressure in the outlet port 23 of the valve 6 will be increased. More specifically, compression of the coil spring 16 causes the spool 13 to move downwardly (FIG. 2) to allow more fluid to flow through the passage 21 until the pressure in the chamber 15 counterbalances the force of the spring 16, whereupon the pressure in the outlet port 23 is higher than it was before the master arm 3 has been angularly moved.

With a pressure build-up in the fluid line 56, the pilot chamber 55 is pressurized to move the valve spool of the directional valve 45 leftwards as shown in FIG. 1, thereby allowing fluid to flow from the pump 61 through the fluid lines 63, 49, the valve 45, the fluid line 48, and the port 47*b* into the fluid-side chamber 40*b* of the cylinder 40. Therefore, the piston rod 41 of the cylinder 40 is extended to cause the slave arm 33 to be angularly moved about the shaft 34 clockwise with respect to the slave boom 31. At this time, the roller of the second remote control valve 36 is depressed by the cam 35 to pressurize the outlet port 59 of the valve 36 and hence the pilot chamber 57 of the directional valve 45 through the fluid line 58. The slave arm 33 continues to move angularly until such time as the pressure in the pilot chamber 57 builds up to a point where it counterbalances the pressure in the pilot chamber 55, whereupon the spool of the directional valve 45 starts being shifted rightwards. Upon arrival at an intermediate position, the directional valve 45 cuts off oil supply to the cylinder 40, stopping the angular movement of the slave arm 33.

When the slave arm 33 has angularly moved due for example to inertia beyond an angular extent dictated by the master arm 3, the roller of the second remote control valve 36 is depressed further, causing the outlet port 59 of the valve 36 to be pressurized further. Accordingly, the pressure in the pilot chamber 57 overcomes the pressure in the pilot chamber 55, so that the spool of the valve 45 continues to be shifted rightwards until it allows fluid to flow from the pump 61 through the fluid lines 63, 49, 46 to the rod-side port 47*a*. The piston rod 41 is now retracted to enable the slave arm 33 to be angularly moved back counterclockwise. With such an arrangement the directional valve 45 is controlled by the remote control valves 6, 36 to enable the slave arm 33 to follow the master arm 3 in angular motion reliably without fail.

Upon completion of the angular follow-up movement of the slave arm 33, the outlet ports 23, 59 of the remote control valves 3, 36, and hence the pilot chambers 55, 57 of the directional valve 45 are pressurized equally.

Figure 4:
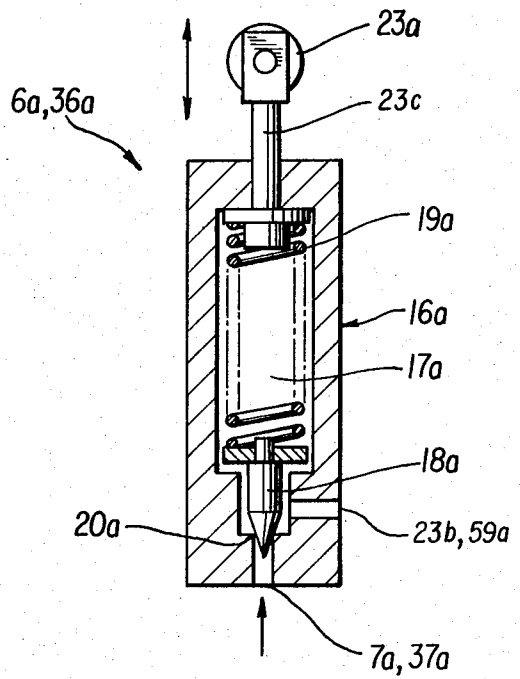
FIG. 4 is an enlarged cross-sectional view of a pressure control valve in the apparatus shown in FIG. 3.
Figure 3:
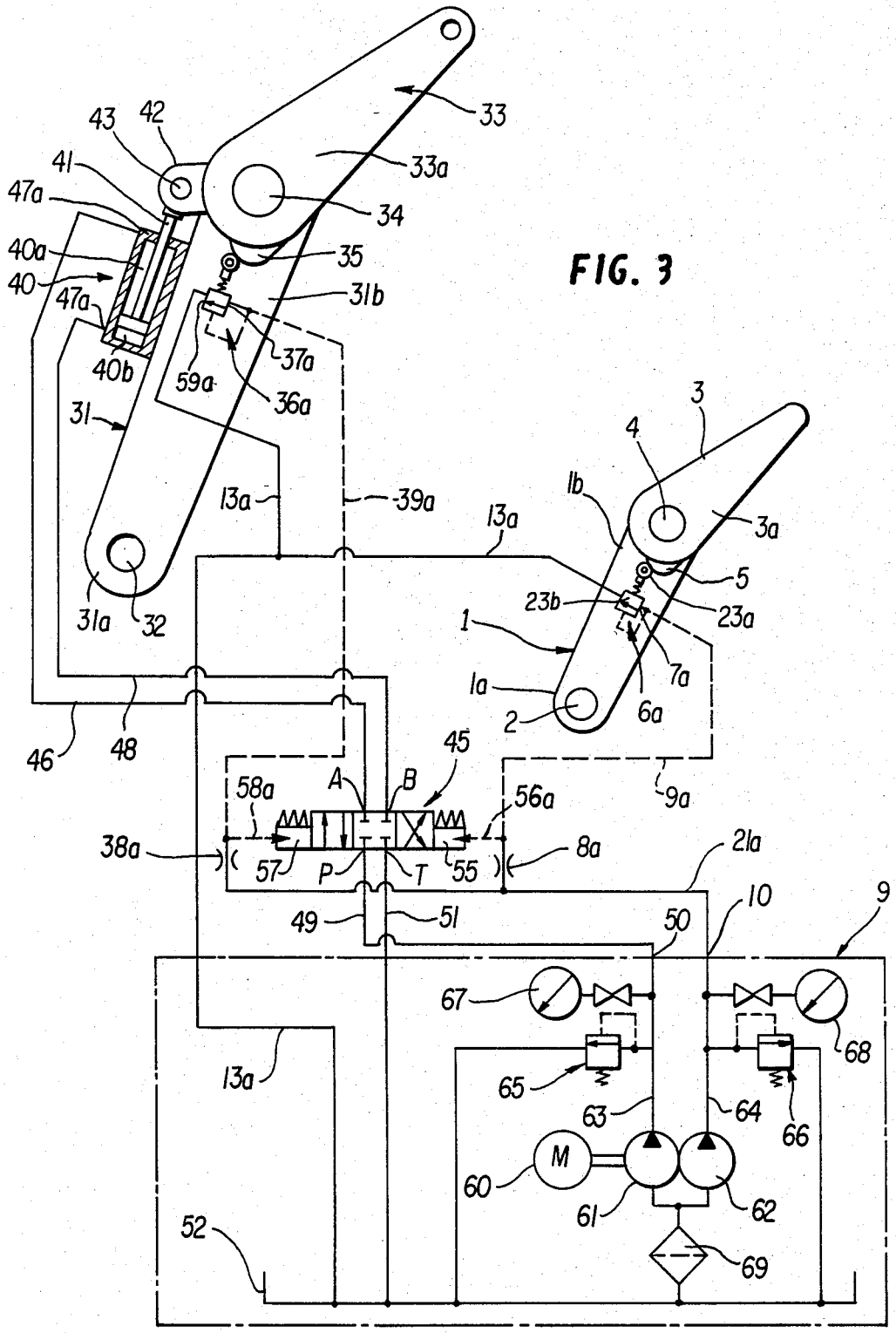
FIG. 3 is a circuit diagram of a fluid-pressure apparatus according to a second embodiment of the present invention.

FIGS. 3 and 4 show a master/slave fluid-pressure apparatus according to another embodiment of the present invention. The corresponding elements referred to in FIGS. 1 and 2 are denoted by the same reference numerals in FIGS. 3 and 4. According to this embodiment, a first relief valve 6*a* is mounted on the master boom 1 for coaction with the cam 5 of the master arm 3. Valve 6*a* has an inlet port 7*a* connected to the port 10 of the fluid-pressure supply 9 via a fluid line 9*a*, a restrictor 8*a* and a fluid line 21*a*. Fluid line 9*a* is connected via a fluid line 56*a* to the pilot chamber 55 of the directional valve 45. First relief valve 6*a* also has an outlet port 23*b* connected to the tank 52 via a line 13*a*.

A second relief valve 36*a* which is mounted on the slave boom 31 for coaction with the cam 35 of the slave arm 33 includes an inlet port 37*a* coupled to the port 10 of the fluid-pressure supply 9 via a fluid line 39*a*, a restrictor 38*a*, and the fluid line 21*a*. Pilot chamber 57 of the directional valve 45 is connected to the fluid line 39*a* through a fluid line 58*a*. Second relief valve 36*a* also has an outlet port 59*a* connected via the fluid line 13*a* to the tank 52.

First and second relief valves 6*a*, 36*a* are of the same construction, and each includes, as shown in FIG. 4, a valve body 16*a* having a chamber 17*a* therein, a poppet 18*a* axially movably disposed in the chamber 17*a* and urged against a seat 20*a* under the force from a coil spring 19*a* placed in compression in the chamber 17*a* so as to block fluid communication between the ports 23*b* (59*a*) and 7*a* (37*a*). The coil spring 19*a* is held against one end of a 23c axially slidably disposed in the valve body 16a and supporting on the other end a roller 23a which is held in rolling engagement with the cam 5 (35). With the relief valve 6a, 36a thus constructed, passage of fluid from the port 7a (37a) to the port 23b (59a) is controlled by a difference between the fluid pressure in the port 7a (37a) and the force of the spring 19a as varied by depression of the roller 23a. Therefore, the pressure in the port 7a (37a) is a function of the force of the spring 19a is controlled by the roller 23a. More specifically, as the coil spring 19a is compressed by engagement of the roller 23a with the cam 5 (35), the poppet 18a restricts fluid flow from the port 7a (37a) to the port 23b (59a). Thus, the pressure in the port 7a (37a) and hence the pressure in the fluid lines 9a, 56a (39a, 58a) varies with the force of the spring 19a which is a function of angular movement of the master arm 3 or the slave arm 33.

When the master arm 3 is angularly moved clockwise as shown in FIG. 3, the cam 5 depresses the roller 23a of the first relief valve 6a. Coil spring 19a is compressed to increase the fluid pressure in the port 7a and hence in the fluid lines 9a, 56a. Thus, the spool of the directional valve 45 is shifted leftwards by pressurization of the pilot chamber 55 until fluid is allowed to flow from the pump 61 through the fluid lines 63, 49, the valve 45, the fluid line 48 and the port 47b into the blind-side chamber 40b of the cylinder 40, while fluid is drained from the rod-side chamber 40a via the port 47a, the fluid line 46, the valve 45, and the fluid line 51 to the tank 52. Piston rod 41 is now extended to cause the slave arm 33 to be angularly moved clockwise in follow-up relation to the master arm 3. At the same time, the roller 23a of the second relief valve 36a is depressed by engagement with the cam 35 to cause a pressure build-up in the fluid lines 39a, 58a. When the fluid pressure in the pilot chamber 57 counterbalances the fluid pressure in the pilot chamber 55, the spool of the directional valve 45 is shifted rightwards to its intermediate position, whereupon oil flow is blocked to de-activate the cylinder 40. The clockwise angular movement of the slave arm 33 is now stopped.

Any excessive angular movement of the slave arm 33 due for example to inertia beyond an angular extent which the master arm 3 dictates, causes the cam 35 to depress the roller 23a further, resulting in a further pressure build-up in the pilot chamber 57 which enables the spool of the directional valve 45 to be moved rightwards until it allows oil flow to go into the rod-side chamber 40a via the fluid lines 49, 46 and the port 47a. Therefore, the piston rod 41 is retracted to enable the slave arm 33 to be angularly moved counterclockwise until such time as the pressures in the pilot chambers 55, 57 are held in equilibrium or in a state of balance.

Figure 5:
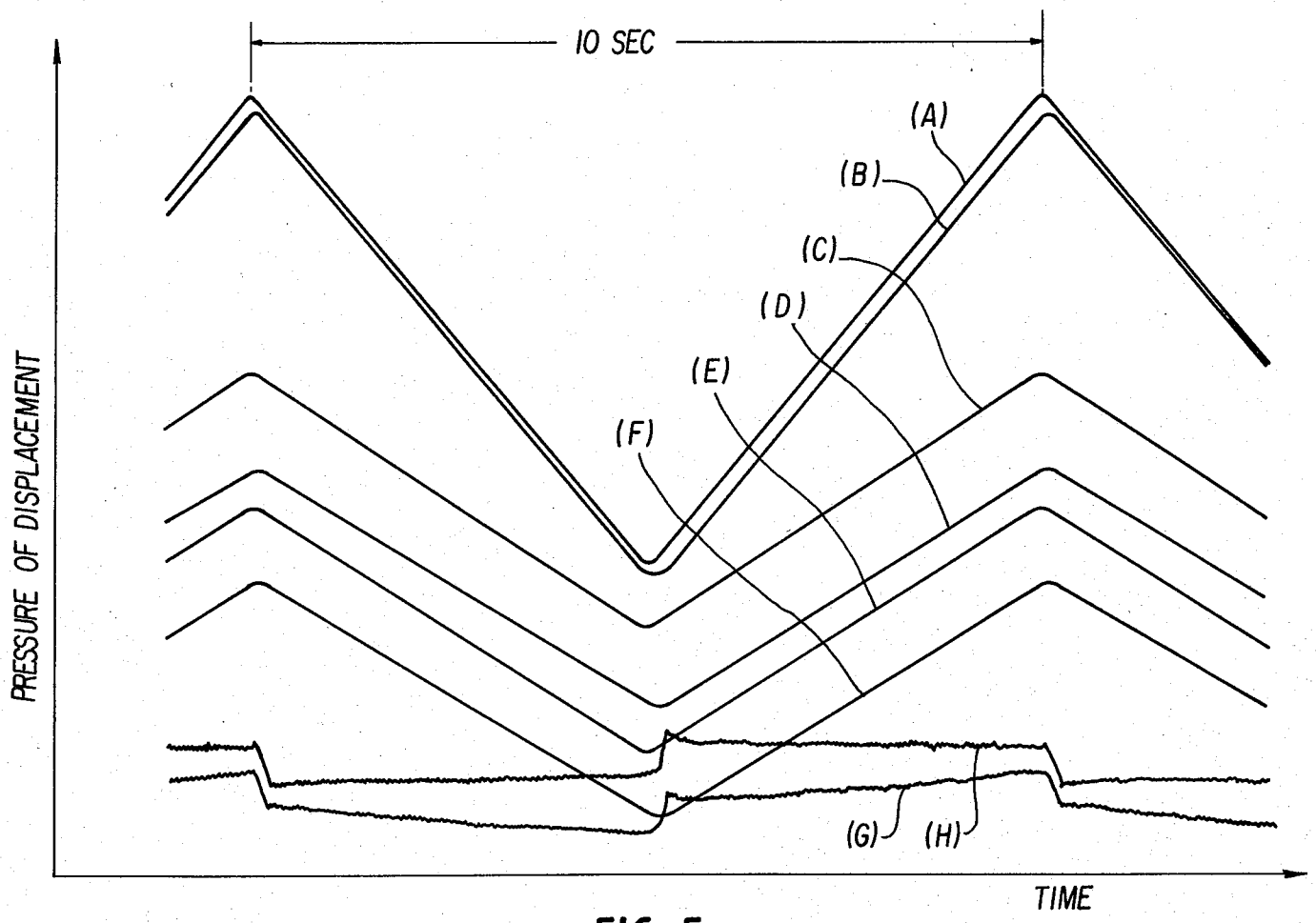
FIG. 5 is a graph illustrative of the performance of the apparatus of FIG. 3.

FIG. 5 shows curves or waveforms experimentally obtained of pressure in or displacement of various parts of the apparatus shown in FIGS. 3 and 4 when the master arm 3 is subjected to a force applied thereto which periodically changes in a triangular waveform as a frequency of 0.06 Hz or a period of 16.5 sec. In FIG. 5, designated at (A) is a curve for angular displacement of the master arm 3, (B) a curve for angular displacement of the slave arm 33, (C) and (D) curves for control pressures of the first and second reief valves 6a, 36a, respectively, (E) and (F) curves for pressures in the pilot chambers 55, 57, respectively, of the directional valve 45, and (G) and (H) curves for pressures in the rod-end and blind-end chambers 40a, 40b of the cylinder 40. From the graph shown in FIG. 5, it will be seen that the slave arm 33 can follow the master arm 3 in angular motion precisely without substantial time delay.

Although certain preferred embodiments have been shown and described in detail, it should be understood that various changes and modifications may be made therein without departing from the scope of the appended claims. For example, the slave boom 31 may be arranged to follow the master boom 1 in angular motion by rendering the master and slave booms 1, 31 angularly movable. Furthermore, the present invention is useful in an application where the master and slave arms make rectilinear motion rather than angular motion.

What is claimed as new and desired to be secured by Letters Patent of the United States is:

1. A master/slave fluid-pressure apparatus comprising:

a first and second shaft;

a master member pivotably mounted on said first shaft and having a first cam member extending therefrom;

a slave member pivotably mounted on said second shaft and having a second cam member and a lobe member, each extending from one end of said slave member;

a fluid-pressure actuator operatively connected to said slave member and which includes means for moving said slave member wherein said means for moving said slave member is connected to said lobe member;

a first hydraulic means for converting displacement of said master member into a fluid pressure;

second hydraulic means for converting displacement of said slave member into a fluid pressure;

a source of fluid pressure for supplying fluid pressure to said fluid-pressure actuator and to said first and second hydraulic means;

a three-position directional valve connected to said fluid-pressure actuator and said fluid pressure supply and having first and second pilot chambers connected to said first and second hydraulic means, respectively, for receiving fluid pressure therefrom, said three-position directional valve being controllable by comparison between the fluid pressure applied to said pilot chambers from said first and second hydraulic means for controlling follow-up movement of said slave member with respect to said master member wherein each said first and second hydraulic means further comprises a restrictor in communication with said fluid pressure source and a relief valve; wherein each said relief valve further comprises a poppet, a roller contacting one of said first and second cams, a roller rod connected to said roller and a coil spring disposed between said roller rod and said poppet; and each said relief valve of said first and second hydraulic means is connected via one of said restrictors to said fluid pressure source; and wherein each said first and second hydraulic means further comprises a first fluid line extending between one of said relief valves and one of said restrictors, and a second fluid line connected between said first fluid line and one of said pilot chambers, whereby said first and second fluid lines of each of said first and second hydraulic means comprise means for applying fluid pressures to said first and second pilot chambers, respectively, so that the fluid pressures in said first fluid lines can be controlled in response to the displacement of said master and slave members.

* * * * *